US008499777B2

(12) United States Patent
Garreau

(10) Patent No.: US 8,499,777 B2
(45) Date of Patent: Aug. 6, 2013

(54) FOLDABLE TENT STRUCTURE ARTICULATED AROUND AT LEAST ONE AXIS, AND TENT INCLUDING SAID STRUCTURE

(76) Inventor: Christophe Garreau, Bouchemaine (FR)

( * ) Notice: Subject to any disclaimer, the term of this patent is extended or adjusted under 35 U.S.C. 154(b) by 70 days.

(21) Appl. No.: 13/192,493

(22) Filed: Jul. 28, 2011

(65) Prior Publication Data

US 2013/0025642 A1 Jan. 31, 2013

(51) Int. Cl.
*E04H 15/36* (2006.01)

(52) U.S. Cl.
USPC ..... 135/132; 135/133; 135/135

(58) Field of Classification Search
USPC ..... 135/130, 132–135, 137, 138, 152–154, 135/98, 99, 100; 160/352, 39, 38
See application file for complete search history.

(56) References Cited

U.S. PATENT DOCUMENTS

| | | | | |
|---|---|---|---|---|
| 932,339 | A * | 8/1909 | Slyder | 135/120.3 |
| 2,818,078 | A * | 12/1957 | White | 135/154 |
| 3,105,505 | A * | 10/1963 | Maybee | 135/135 |
| 3,121,439 | A * | 2/1964 | Moltchan | 135/132 |
| 3,368,575 | A * | 2/1968 | Besonen | 135/147 |
| 3,513,861 | A * | 5/1970 | Johnson | 135/132 |
| 4,520,835 | A * | 6/1985 | Moeller | 135/133 |
| 5,159,948 | A | 11/1992 | Moreau et al. | |
| 5,573,027 | A * | 11/1996 | Hsiung | 135/142 |
| 5,918,615 | A * | 7/1999 | Stuck, Sr. | 135/135 |
| 7,938,135 | B2 * | 5/2011 | Desfosses et al. | 135/135 |
| 2006/0272695 | A1 | 12/2006 | Mettavant | |
| 2007/0215192 | A1 * | 9/2007 | Hoffman | 135/135 |

FOREIGN PATENT DOCUMENTS

| | | |
|---|---|---|
| EP | 0408450 | 1/1991 |
| EP | 1697604 | 9/2006 |
| WO | 2008004953 | 1/2008 |

* cited by examiner

*Primary Examiner* — Noah Chandler Hawk
(74) *Attorney, Agent, or Firm* — Young & Thompson

(57) ABSTRACT

Foldable tent structure that includes the assembly of a number of curved half-poles that are connected to one another in their upper part according to a general radial arrangement to form, in the deployed state, the frame that supports the fabric of the tent and that can be folded against one another to store the frame. Each half-pole includes at least one lower section and one upper section divided into two branches that go—by separating from one another—toward their distal ends and are kept separated to constitute a lower arch and an upper arch arranged one below the other, the distal ends of the branches being mounted to pivot around at least one vertical axis of rotation located close to the central part of the structure, with the branches kept separated by at least one bracket, arranged along the axis of rotation, the lower sections of the half-poles each extending in their lower part by a holding element of their lower ends relative to one another in the deployed state and forming the base of the structure designed to rest on the ground.

5 Claims, 9 Drawing Sheets

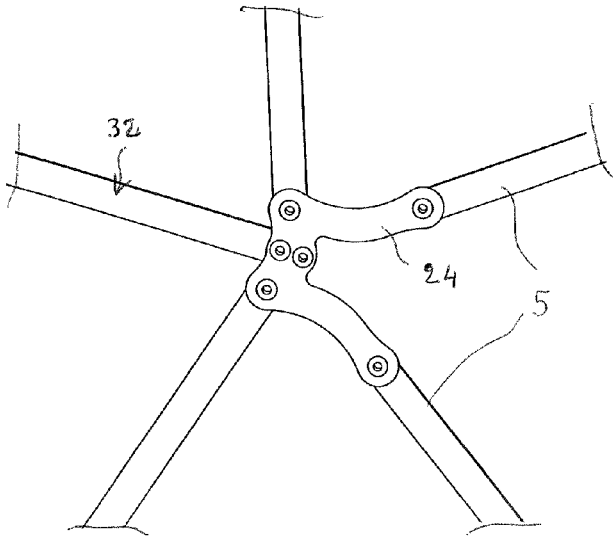
Fig. 11
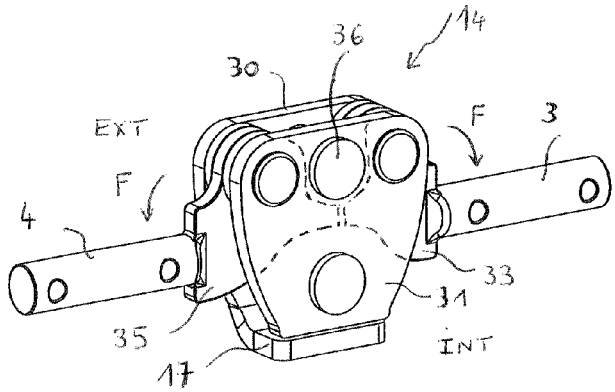
Fig. 12
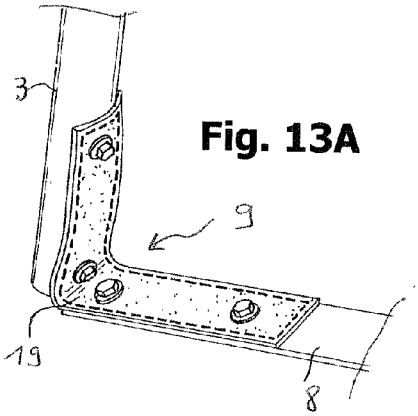
Fig. 13A
Fig. 13B
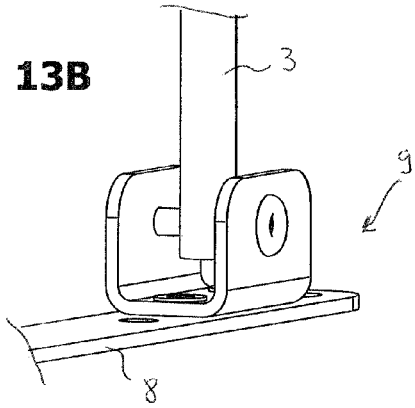

FOLDABLE TENT STRUCTURE ARTICULATED AROUND AT LEAST ONE AXIS, AND TENT INCLUDING SAID STRUCTURE

FIELD OF THE INVENTION

This invention relates to the field of foldable tents, and more particularly a foldable tent structure, formed by a number of frame sections, as well as the tent that comprises a fabric fixed to this frame.

CONTEXT AND PRIOR ART

In a general manner, the tents consist of a frame on which a cover element such as a fabric or a tarpaulin comes to rest or to which said cover element is attached.

For tents such as those for backpacking, users want them to have the advantages of rapid assembly and easy folding, as well as reduced weight and bulk for purposes of storage and transport.

Among the existing tent structures, tubular structures with interlocking of different independent rectilinear segments forming the frame are known. These structures are certainly less bulky for storage and transport, but assembling them is tedious. This assembly first requires collecting and assembling different segments for forming the frame of the tent and then fitting the fabric thereto.

Furthermore, there are also structures with flexible poles, whereby the poles are inserted into sleeves that are integral with the tent fabric (EP-A-0 408 450) so as to assume the required shape and to stretch the fabric. More recently, self-deploying tents that comprise a flexible pole structure in the form of two loops, namely a base loop and an upper loop housed in sleeves that are connected to or integrated into the roof fabric, have also been developed (EP-B-1 697 604). These tents are therefore very quick to assemble (several seconds), but folding them up is complex and difficult. In addition, the minimum storage configuration of these tents has a circular shape, which constitutes an obstacle to the transport of these tents, in particular in hikers' backpacks.

Other tent structures that comprise a frame that is deployed around a central mast, which can be troublesome depending on the desired use of the tent, or else other structures that have an umbrella-type upper part, reinforced by springs that connect the upper part and the side posts to prevent them from being damaged during a wind gust, for example, are also known. Structures of medical tents that comprise posts that are curved in their upper part and that are mounted to rotate around a common vertical axis so as to form, in the deployed state, the frame that is designed to support the roof of the tent, are also known, but these latter structures have very poor stability in the wind (WO2008/004953).

OBJECT OF THE INVENTION

The primary object of this invention is therefore to eliminate the drawbacks of the existing tent structures and to propose a tent that is deployed easily and quickly, is easy to fold, and is not very cumbersome for storage and transport. This structure should also have good wind resistance.

SUMMARY OF THE INVENTION

For this purpose, this invention relates to a foldable tent structure that comprises the assembly of a number of curved half-poles that are connected to one another in their upper part according to a general radial arrangement so as to form, in the deployed state, the frame that supports the fabric of the tent and that can be folded against one another to store the frame, in said structure, each half-pole consists of, on the one hand, at least one lower section, and, on the other hand, an upper section that is divided into two branches that go—by separating from one another—toward their distal ends and are kept separated so as to constitute a lower arch and an upper arch arranged one below the other, the distal ends of the branches of the half-poles, so-called pivoting half-poles, being mounted to pivot around at least one vertical axis of rotation located close to the central part of the structure, with said branches of the half-poles being kept separated by at least one bracket, arranged along said at least axis of rotation, the lower sections of the half-poles each extending in their lower part by an element for holding their lower ends relative to one another in the deployed state and forming the base of the structure designed to rest on the ground.

According to a first embodiment of the invention, the holding element is a rectilinear element of which a first end is connected to said lower section, and a second end is mounted to pivot around at least one axis of rotation located in the extension of said at least one axis of rotation of the upper branches of the pivoting half-poles, whereby the holding elements of the set of half-poles form, in the deployed state, the base of the structure that is designed to rest on the ground.

In this first embodiment of the invention, two variants are considered.

According to the first variant, the pivoting half-poles are mounted to pivot around a single common vertical axis, with a single bracket being arranged along said vertical axis between the set of upper branches and the set of lower branches, whereby the rectilinear holding elements of the lower sections of the half-poles are connected to one another, at their second ends, to rotate around said vertical axis.

According to a second variant, the distal ends of the branches of the pivoting half-poles are mounted to pivot on a pair of connecting plates, arranged at the peak of the structure, around distinct vertical axes of rotation and separated from one another, with at least two brackets being arranged between the plates of said pair of plates along said two axes of rotation so as to keep said branches of half-poles separated, with the rectilinear holding elements being connected to a lower connecting plate arranged at the base of the structure, perpendicular to said pair of connecting plates, whereby said holding element is mounted to pivot around axes located in the extensions of the axes of rotation of the upper branches of the pivoting half-poles, with the holding elements of the set of half-poles and the lower connecting plate forming, in the deployed state, the base of the frame that is designed to rest on the ground.

Preferably, brackets are arranged between the plates of said pair of connecting plates along each of said axes of rotation.

The structure according to the invention, self-supported, thus does not comprise a central mast, but only a number of brackets that keep the arches separated from the half-poles of the frame and around which these half-poles are articulated to rotate. This arrangement, corresponding essentially to a triangle (one side of which consists of said bracket and whose peaks are the connecting points between the latter and the upper and lower arches and the dividing point of these two arches), considerably stiffens the upper part of the frame and reinforces its stability by preventing the half-poles from bending and separating "twisted" during the unfolding of the frame.

In an advantageous manner, the half-poles are made of flexible material, preferably made of aluminum, glass fiber, or carbon fiber. Thus, the structure does not have a spring that connects or reinforces the sections between one another. The frame no longer comprises a central mast that is troublesome for certain activities or certain uses of the tent.

This flexibility of the half-poles makes it possible both to curve them for storage and—during their deployed position—to withstand the wind effects or other outside forces acting on the frame.

To facilitate the storage of the frame, it is possible to provide at least one articulation in the lower section or between the lower and upper sections of each half-pole; thus, these lower and upper sections of each half-pole are articulated between one another for facilitating the folding of the frame and for reducing its bulk. This articulation can be in the form of an anti-pinching hinge to prevent the fabric from becoming wedged in the latter. Preferably, such an articulation allows a freedom of rotation that is less than or equal to 180 degrees so that the lower and upper sections of the half-pole in the deployed state are essentially rectilinear.

It was determined that the length of each rectilinear element is advantageously less than the length of the associated half-pole, making possible, during the unfolding of the frame and placing it on the ground at the base of the frame (i.e., the set of said rectilinear elements forming underframes), the automatic and instantaneous deployment of said half-poles upward for forming the roof frame of the tent, as well as keeping the curvature of the half-poles in the deployed state.

The rectilinear holding elements can come in the form of straps. As a variant, the rectilinear holding elements can be in the form of rigid rods, for example in the form of flat rods, preferably made of aluminum, glass fiber, or carbon fiber, forming the underframes of half-poles to which they are articulated at respective lower sections of said half-poles. These underframes are easily inserted under the ground cloth of the tent.

To further enhance the ease of storage of the frame, the articulation between the underframe and the lower section of each half-pole can be produced by means of a rigid, hinge-type articulation or by means of a link, preferably in the form of a flexible strip or straps, whose ends are made integral respectively with the underframe and said lower section of the half-pole, so as to allow, for the storage of the frame, after the half-poles are clustered, the folding of the underframes against the lower sections of the set of clustered half-poles.

Also to prevent the tent fabric, fixed to said half-poles of the structure, from being wedged and damaged during the folding of different sections of the frame, it is advantageous that said axes of rotation are uniformly distributed on the periphery of the connecting plates so as to position said upper sections parallel to one another and said underframes parallel to one another, preferably without overlapping, during the folding of the frame.

For the purpose of also reducing the bulk of the frame, it may be provided that each underframe of the half-poles is equipped with at least one intermediate articulation, preferably made at mid-length of the underframes, so that in the clustered state of the underframes, the latter are arranged parallel to one another to allow their folding by means of said intermediate articulation, the first and second ends of the underframes then being found close to one another.

According to another variant embodiment of the invention, the structure comprises at least one additional half-pole, made integral with each of said connecting plates, with the pivoting half-poles being—in the clustered state of the half-poles—preferably arranged on either side of said fixed half-pole. This fixed half-pole constitutes an element for stiffening and aligning—in the deployed state of the structure—the pair of connecting plates from the peak with the lower connecting plate. In addition, it may be used as a reference element, for the folding of the structure, with the clustering of pivoting half-poles.

According to a second embodiment of the invention, the holding element can advantageously be a holding element that is common to all of the half-poles, connecting the set of lower ends of the lower sections of the half-poles, such as a ground cloth of the tent, arranged—in the deployed state of the frame—between the lower sections of the half-poles. This ground cloth is then completely stretched between the half-poles.

Preferably, the half-length (equivalent to a "half-diameter") of the common holding element, of the ground cloth type, is less than the length of the half-poles to which it is connected, making possible, during the unfolding of the frame and the positioning on the ground of the ground cloth, the automatic and instantaneous deployment of said half-poles upward to form the roof frame of the tent, as well as keeping the curvature of the half-poles in the deployed state.

This invention also relates to a tent that comprises a structure such as the one described above, and a first cover element, such as a fabric or a tarpaulin, fixed at several fixation points at least at each of the upper arches and/or at least at each of the lower sections of the half-poles, constituting the roof of the tent and optionally at least one second fabric- or mosquito netting-type element that is fixed, inside the structure, at least at each of the lower arches of the half-poles, forming the walls of at least one inside chamber of the tent.

BRIEF DESCRIPTION OF THE FIGURES

This invention is illustrated by the nonlimiting examples below referring to the accompanying diagrams, in which:

FIG. 11 is a detail top view of the connecting plate of the peak of the structure of FIG. 8;

FIG. 12 shows a detail of an example of articulation of the upper and lower sections of a half-pole of the structure according to the invention;

FIGS. 13*a* and 13*b* are detail views of two examples of articulation between the underframe and the lower section of a half-pole according to the first embodiment of the invention;

DETAILED DESCRIPTION OF PREFERRED EMBODIMENTS

Figure 1:
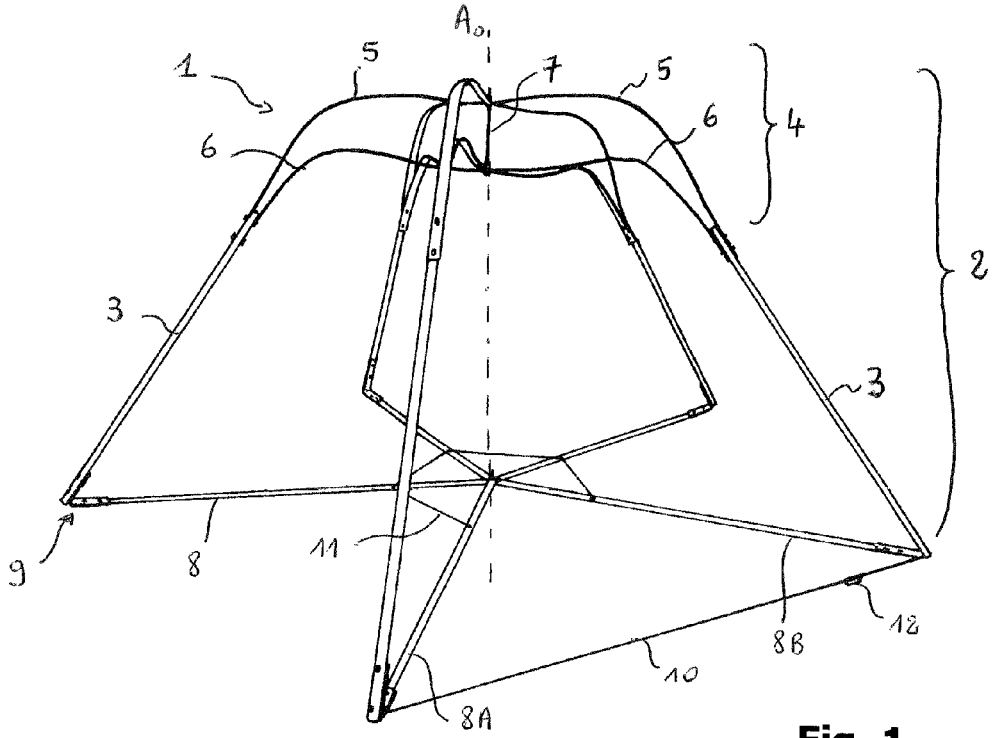
FIG. 1 is a perspective view of a first embodiment of the structure of the invention, according to a first variant, showing the frame in the deployed state.

As indicated above, FIGS. 1 to 14 exhibit a first embodiment of the invention. FIG. 1 shows a foldable tent structure 1 that consists of, according to a first variant, a number of half-poles 2 that are curved in their upper part and mounted to rotate around a common vertical axis $A_o$ and that extend in their lower part by underframes 8 whose free ends are also mounted to rotate around said vertical axis $A_o$. These half-poles and underframes are located in a radial arrangement around said common vertical axis A and constitute, in the deployed state, as exhibited in FIG. 1, the frame of the tent.

A thin cord-type link 11 is provided between two adjacent underframes 8, limiting the underframes' respective separation. Finally, to close said frame, a connecting link 10 combined with a hook 12 is provided between the end underframes 8A and 8B.

Each half-pole 2 made of flexible material consists of, on the one hand, at least one lower section 3, for example in the form of a tubular element, essentially rectilinear or slightly curved, and, on the other hand, a curved upper section 4 that divides into two branches that are separated from one another toward their distal end. These two branches are kept separated by means of a single common bracket 7 that is arranged along said vertical axis $A_o$, so as to constitute an upper arch 5 and a lower arch 6 arranged one below the other, with the lower arch 6 of a half-pole being arranged perpendicular to the upper arch 5 of the same half-pole.

Figure 2:
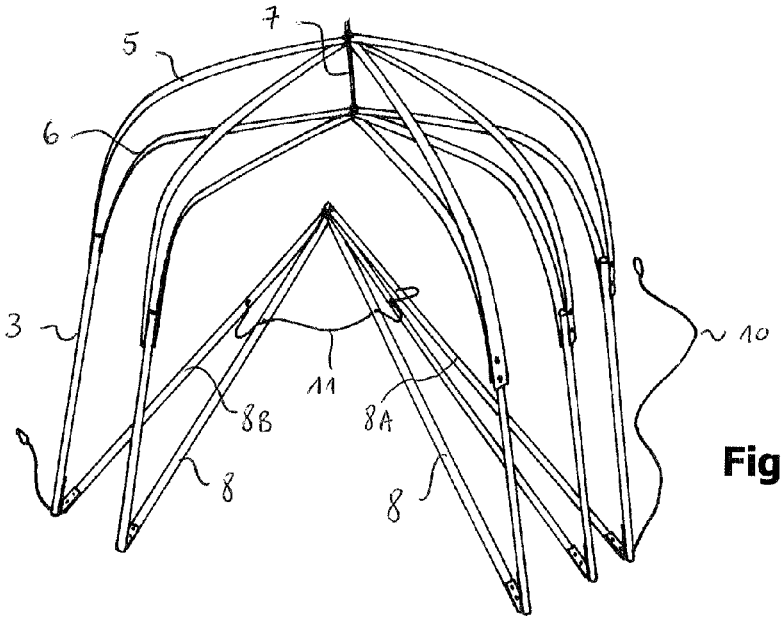
FIG. 2 is a perspective view of the structure of FIG. 1 during folding.
Figure 3:
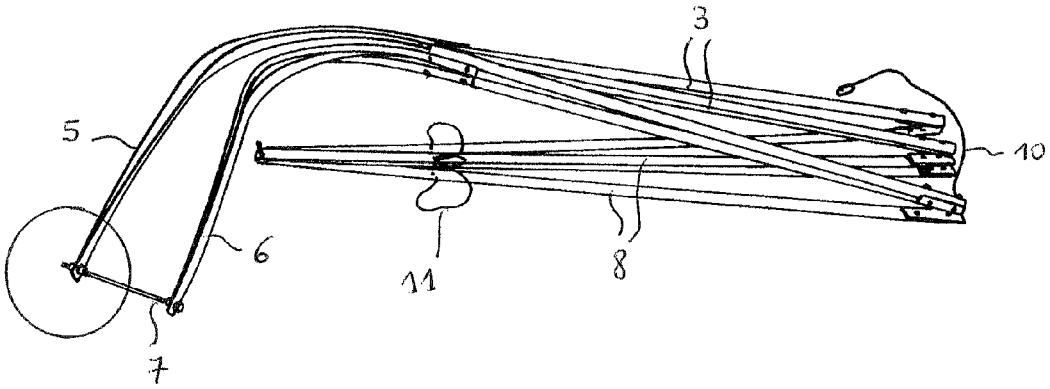
FIG. 3 is another view of the structure of FIG. 1 at the end of folding.

To fold this structure, as can be seen in FIGS. 2 and 3, it is sufficient to detach the connecting link 10, connecting the two adjacent underframes 8A and 8B, from the hook 12 and clustering the different underframes against one another around the axis of rotation $A_o$, this also involving the rotation of the half-poles around said axis $A_o$.

During this clustering, the underframes 8 are folded against said lower sections of the half-poles using the articulation 9 that is made by means of a link, for example a flexible link 19, as shown in FIG. 13A, or a rigid articulation, as shown in FIG. 13B.

Figure 4:
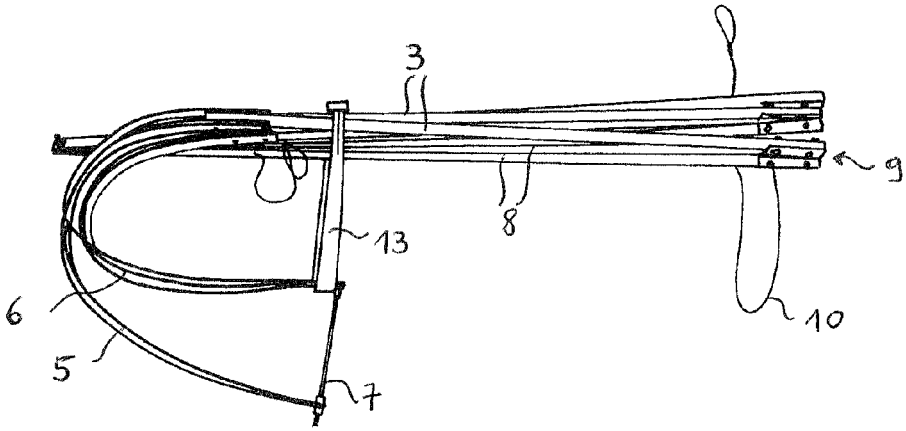
FIG. 4 is a perspective view of the structure of FIG. 1 that is folded and attached for the purpose of its storage.

With the branches of the upper section 4 of the half-poles 2 being flexible, they straighten out during the folding of the frame, but it is possible to make them curved again for the purpose of final storage of the frame (see FIG. 4). A tie 13 can then be provided to hold these sections in a curved position.

Figure 5:
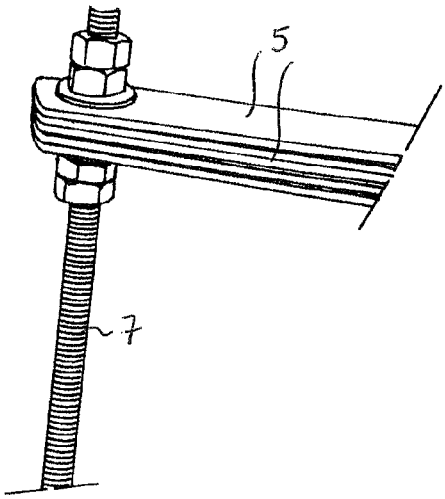
FIG. 5 is a detail view of the peak of the structure of FIG. 1 in the folded state of the frame.
Figure 6:
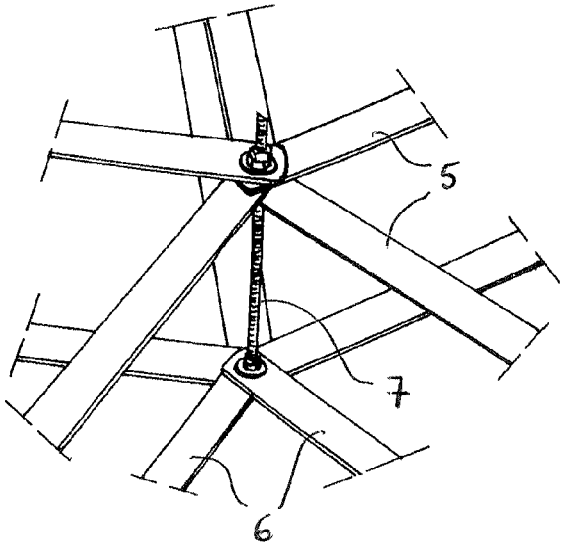
FIG. 6 is a detail of the upper and lower arches of the frame of FIG. 1 in the deployed state.

The details of FIGS. 5 and 6 show that the bracket 7 can be, for example, in the form of a threaded rod on which flat rods that consist of upper arches 5 and lower arches 6 of the half-poles 2 are mounted to rotate.

FIG. 5 shows in particular the small bulk of the upper arches 5 that are superposed when they are folded, and FIG. 6 shows the star-shaped arrangement of these arches in the deployed state of the structure.

The structure that is described above constitutes the frame of the tent. A first cover element such as a fabric 20 or a tarpaulin is fixed at several points at least at each of the upper arches 5 of the half-poles of the armature for the purpose of constituting the roof of the tent, as exhibited in FIG. 7.

It is also possible to add there a second cover element—of mosquito netting or fabric type—fixed at at least several of the lower arches of the half-poles to constitute the walls of one or more inside chambers of said tent (not shown in this figure). In this case, the separation between the upper arches 5 and the lower arches 6 makes it possible to provide a volume of insulating air between the fabrics of the roof and inside chambers.

It is also possible, according to a variant that is not shown, for a set of double-roof fabric and mosquito netting to be fixed below the poles 2, whereby the double-roof fabric is attached by thin cords or straps, preferably elastic, to the frame (end of the underframes 8, poles 2 and arches 5, 6).

Figure 8:
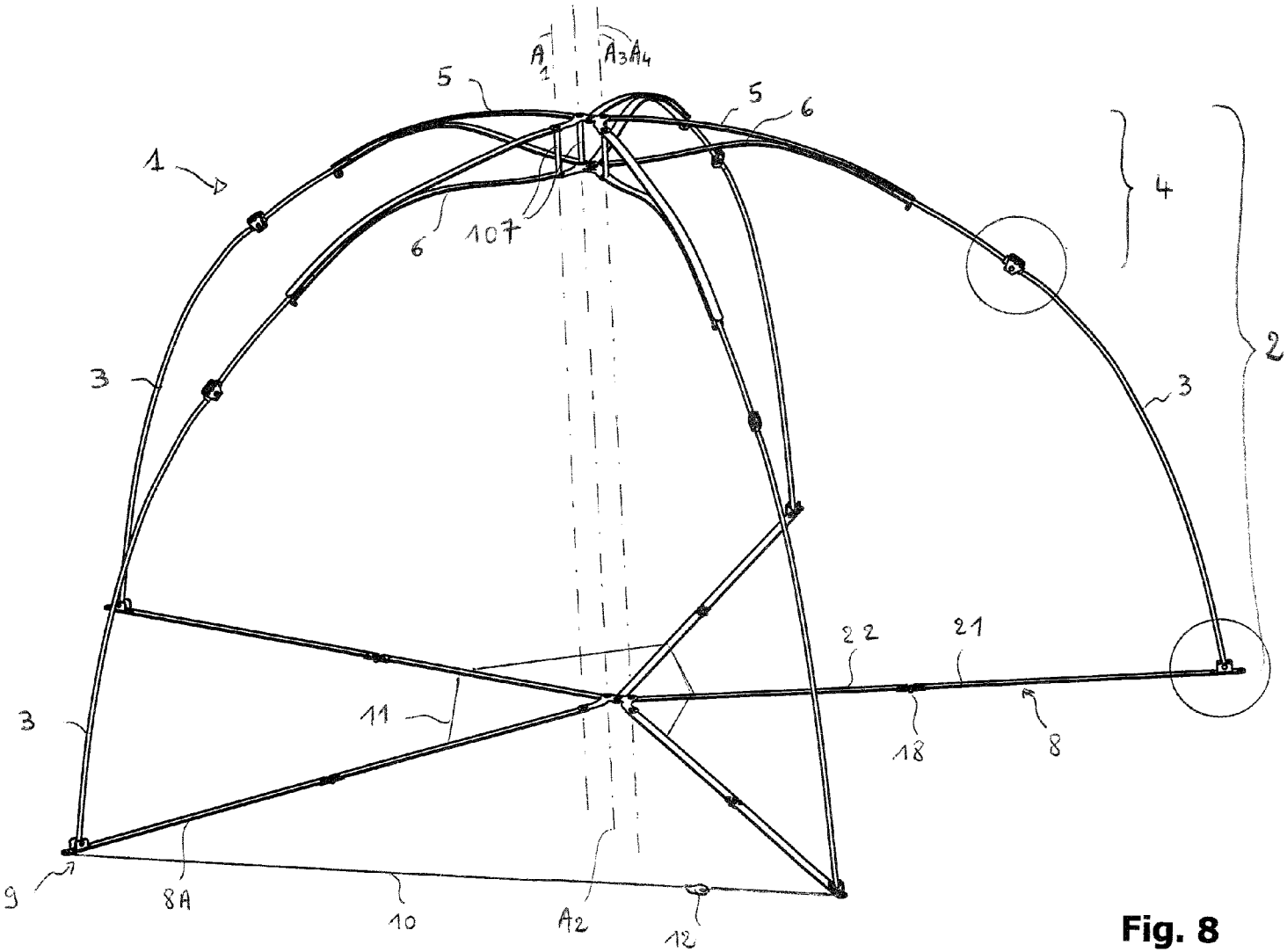
FIG. 8 is a perspective view of a second variant of the first embodiment, with the structure of the invention showing the frame in the deployed state.

FIG. 8 shows a general perspective view of a foldable tent structure 1 according to a second variant of the first embodiment of the invention. This tent structure also consists of a number of half-poles 2 that are curved and connected to one another in their upper part and in their lower part by their extensions that form underframes 8 here. These half-poles and underframes are arranged to pivot on connecting plates 24, 34 and 44 that are essentially horizontal and parallel to one another and constitute, in the deployed state according to a general radial arrangement around these plates as exhibited in FIG. 8, the frame of the tent. The pivoting half-poles and their underframes move in rotation around a number of axes (here, four axes) A1, A2, A3 and A4, shown in diagram form in FIGS. 8, 9, and 10. These axes are distinct and separated from one another.

A thin cord-type link 11 is provided between two adjacent underframes 8, limiting the underframes' respective separation. Finally, to close said frame, a connecting link 10 combined with a hook 12 is provided between the end underframes 8A and 8B, as can be seen in FIG. 8 (according to a variant, not shown, the thin cord-type link can be fixed between the upper sections for the purpose of limiting the separation of the half-poles).

Each half-pole 2 made of flexible material consists of, on the one hand, at least one lower section 3, for example in the form of a tubular element, essentially rectilinear or slightly curved, and, on the other hand, a curved upper section 4 that divides into two branches that are separated from one another toward their distal end. These two branches are kept separated by means of a number of brackets 107 that are arranged along the vertical axes of rotation $A_1$, $A_2$, $A_3$ and $A_4$ of the half-poles, so as to constitute an upper arch 5 and a lower arch 6 arranged one below the other, with the lower arch 6 of a half-pole being arranged perpendicular to the upper arch 5 of the same half-pole.

To fold this structure, it is sufficient to detach the connecting link 10, connecting the two adjacent underframes 8A and 8B, from the hook 12 and to cluster the different underframes against one another around axes of rotation, this also involving the rotation of the half-poles around these same axes $A_1$, $A_2$, $A_3$ and $A_4$.

During this clustering, the underframes 8 are folded against said lower sections of the half-poles using the articulation 9 that is made by means of a link, for example a flexible link 19, as shown in FIG. 13A, or a rigid articulation, shown in diagram form in FIG. 13B.

The structure described above constitutes the frame of the tent. A first cover element such as a fabric or a tarpaulin can be fixed at several points at least at each of the upper arches 5 of the half-poles of the frame for the purpose of constituting the roof of the tent (as in the first variant shown in diagram form in FIG. 7).

Figure 9:
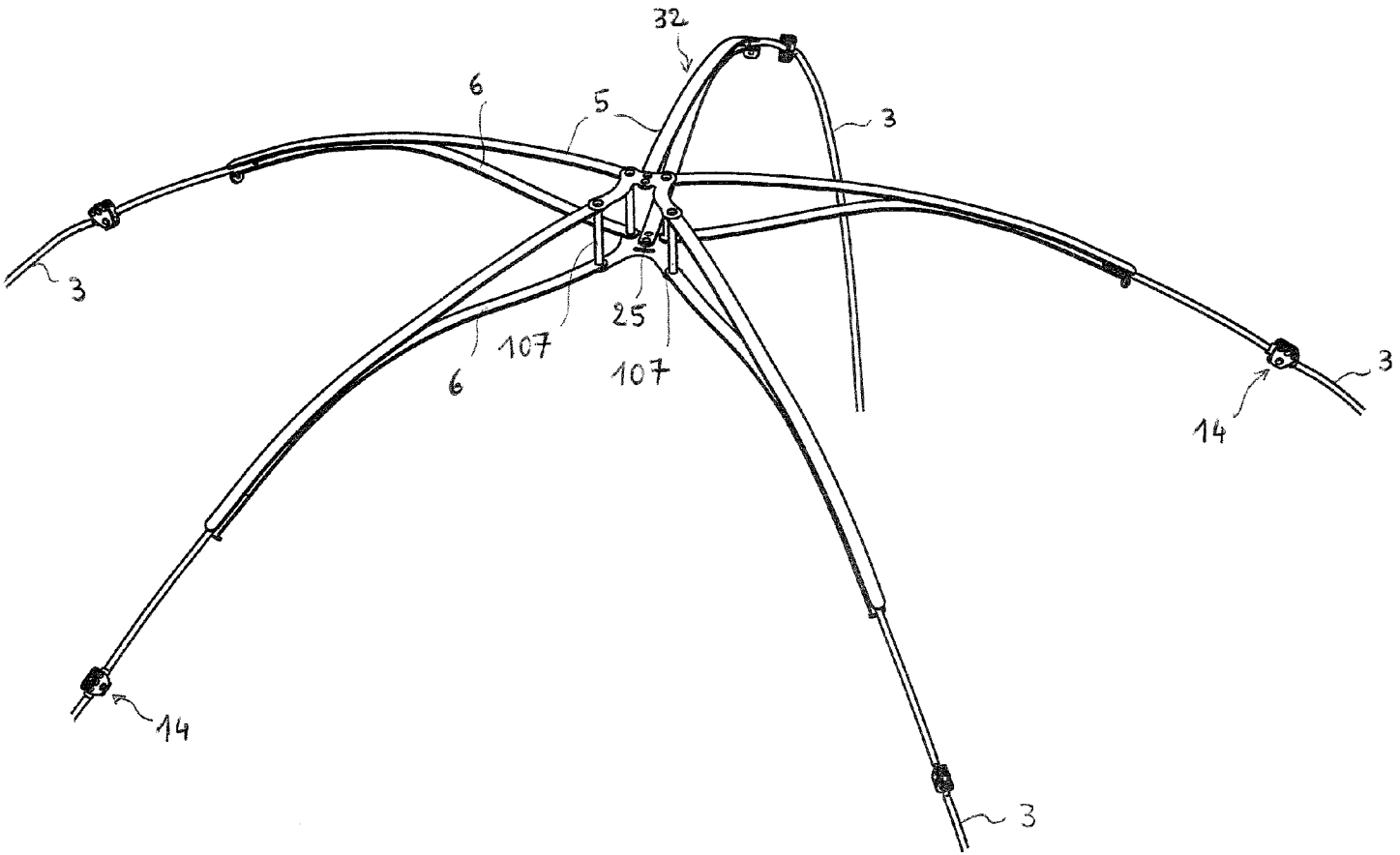
FIG. 9 is a perspective view of the peak of the structure of FIG. 8.
Figure 10:
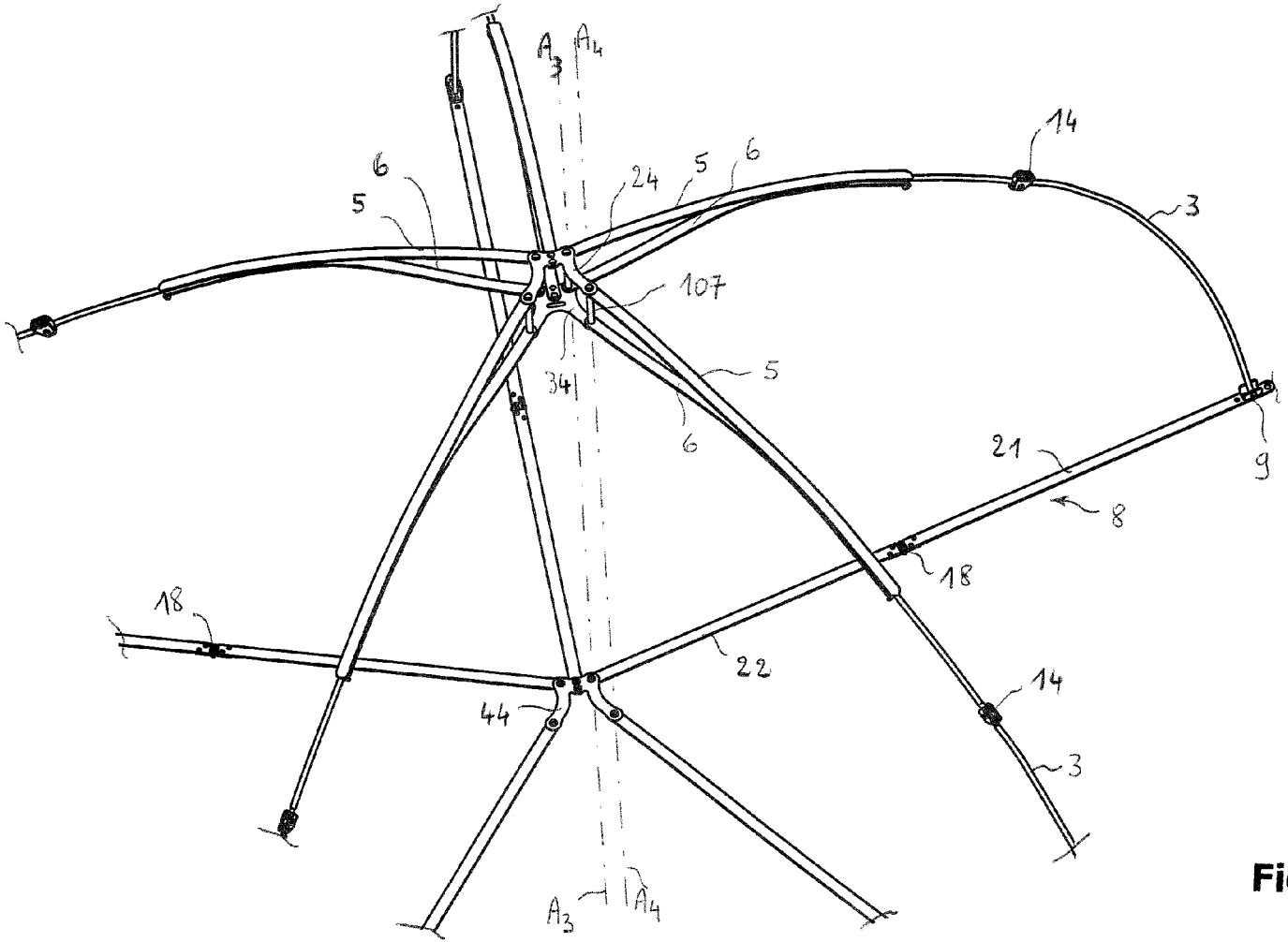
FIG. 10 is a partial perspective top view of the structure of FIG. 8.
Figure 14:
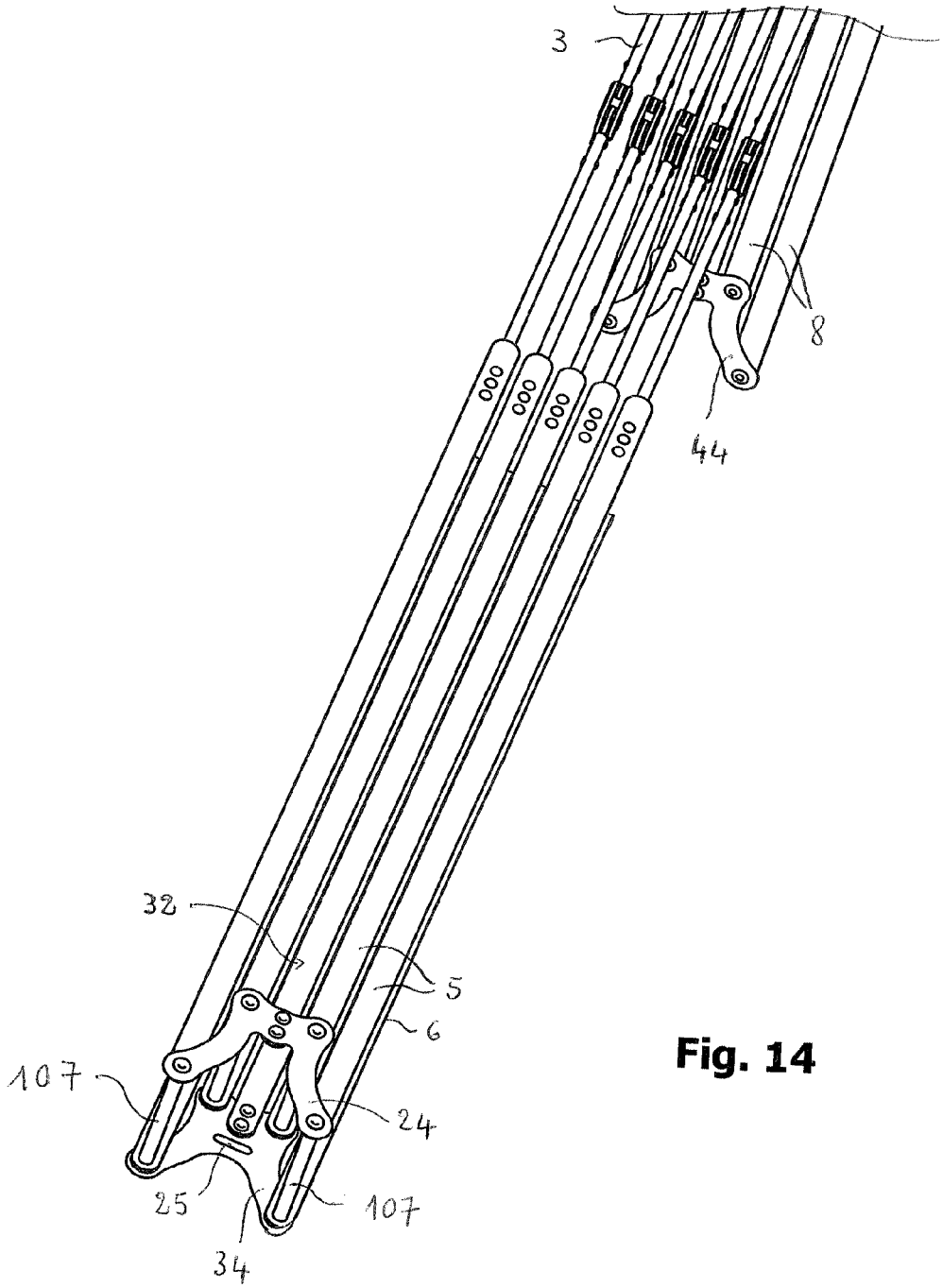
FIG. 14 is a partial view of the structure of FIG. 8 in the folded state.
Figure 15:
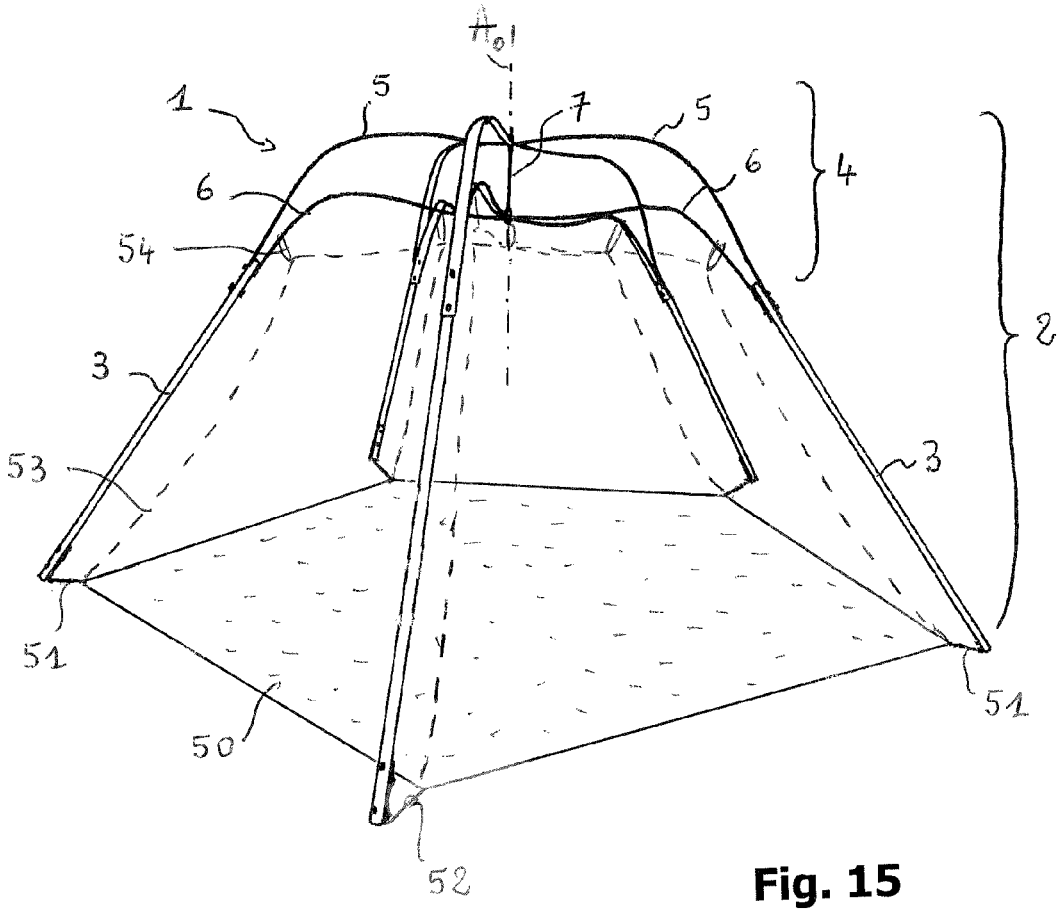
FIG. 15 is a perspective view of the structure according to the second embodiment of the invention that shows the frame in the deployed state.

It is also possible to add there a second cover element—of mosquito netting or fabric type—fixed at at least several of the lower arches 6 of the half-poles and also to an eyelet 25 (as can be seen in FIGS. 9, 10 and 14) to constitute the walls of one or more inside chambers of said tent (see an example in dotted lines in FIG. 15).

Figure 7:
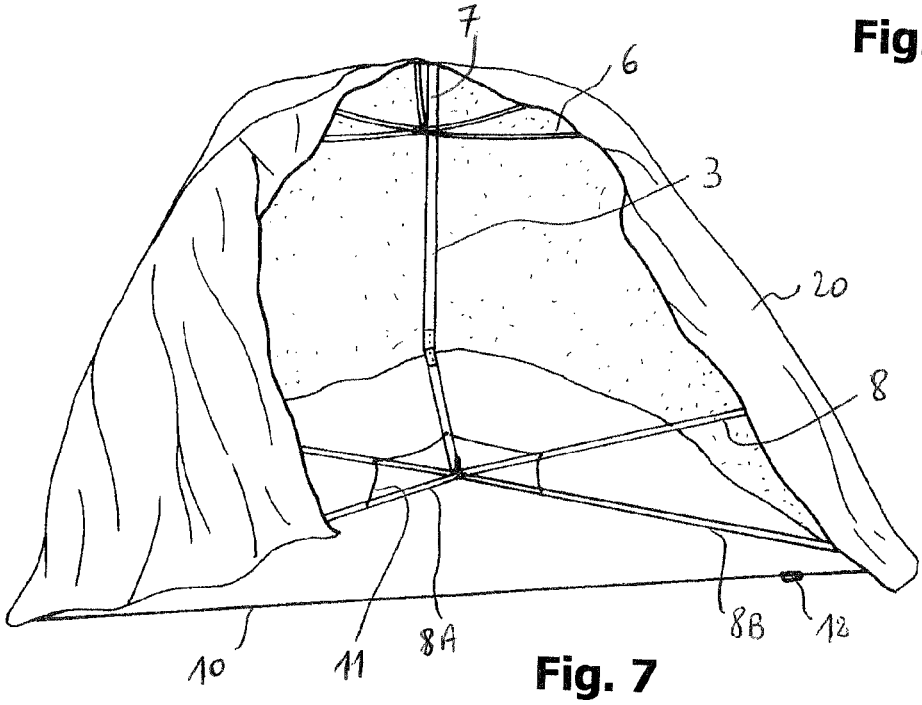
FIG. 7 is a perspective view of a tent according to the invention that comprises the frame of FIG. 1 that is covered by a fabric.

The connecting plates 24, 34 and 44 are preferably flat elements, whose general shape can be a half-crown, a splayed U or, as here, an approximate W shape; the connecting zones, in the form of pivots, of the half-poles to said plates are uniformly distributed on the periphery of these plates in such a way as to allow an arrangement, in the clustered state, of half-poles that are parallel to one another: with the upper and lower branches, as well as the underframes, thus being superposed, as shown in diagram form in FIG. 7, parallel to one another, and preferably without overlapping, i.e., slightly separated from one another. Such an arrangement has the advantage in particular of allowing it to be easily folded up while preventing the tent or mosquito netting fabric from becoming wedged between the latter.

In the embodiment exhibited in FIGS. 8, 9, 10 and 14, the half-poles of the frame according to this invention are five in number, including a fixed half-pole 32, which is made integral by means of two rivets with three connecting plates 24, 34 and 44, more specifically at the center of the W shape, so as to fold the four rotating half-poles on either side of the latter, two on each side, parallel to the latter.

According to an enhancement of this first embodiment that can be seen in FIGS. 8 and 14, it is possible to provide for each underframe 8 of half-pole 2 an intermediate articulation 18 that is arranged preferably at mid-length of the underframe 8, dividing the latter into two parts, a first part 21 on the side of the first end of the underframe, i.e., at the end that is connected to the lower section 3 of the half-pole 2, and a second part 22 that is arranged between said intermediate articulation 18 and the second end of the underframe 8.

The presence of this intermediate articulation makes it possible to fold the frame in a still more compact manner using a smaller space requirement of the folded underframes, with the parts 21 and 22 of these underframes being found one above the other in the folded state as exhibited in FIG. 7.

Said intermediate articulation 18 can be in the form of a rigid hinge or a flexible link such as the articulation 9, exhibited in FIG. 13A, between the lower section 3 of the half-pole 2 and the underframe 8.

According to a second embodiment of the invention that is shown in diagram form in FIG. 15, the lower section 3 of the half-poles 2 each extend in their lower part by an element 50 for holding their lower ends relative to one another in the deployed state as can be seen in this figure. This holding element 50 that is common to all of the half-poles is here a ground cloth that connects the set of lower ends of the lower sections 3 of the half-poles and prevents the lower sections of the half-poles from separating from one another both relative to the opposite half-poles and the adjacent half-poles. This holding element 50 is completed by ties 51 connected directly to the lower section 3; one of these ties comprises a hook 52 that makes it possible to detach it from the corresponding lower section for folding the half-poles against one other for the purpose of storing the frame here with the ground cloth.

A second fabric-type element, such as, for example, a mosquito netting 53 that is shown in diagram form in dotted lines in FIG. 15, can be made integral in its lower part of the ground cloth 50 and can be fixed in its upper part at each of the lower arches 6 of the half-poles and at the bracket 7 of the peak of the frame by flexible links 54.

According to one enhancement of all of the embodiments of the invention exhibited above, each half-pole 2 consists of a lower section 3 and an upper section 4 that are located—in the deployed state of the frame—in the extension of one another and articulated by means of a hinge-type articulation 14 of which an example is shown in FIG. 12. This lower section 3 and this upper section 4 are made integral with pivoting parts, respectively 33, 35, housed between two flanges 30, 31 forming a protective housing.

Said parts 33, 35 (shown partially in dotted lines in FIG. 5) move in rotation around axes that are orthogonal to the flanges 30, 31. The shape and arrangement of the parts 33, 35 are such that in the deployed state, they abut against one another and against the upper central rivet 36 (see FIG. 5) so as to limit the opening, along the arrows F of sections 3 and 4 from the outside EXT to the inside INT of the frame, at an angle of approximately 180°; i.e., in the deployed state of the structure, the sections 3 and 4 of said half-poles are essentially aligned.

The use of such hinges 14 comprises several advantages:

Because of the presence of a space between the pivoting parts 33, 35 and the flanges 30, 31 that form a protective housing, the fabric of the tent cannot remain wedged between the latter, The shape of the half-poles combined with their underframes has a tendency to separate these said poles toward the outside EXT, and during a very violent wind gust or another significant force applied to the frame by the outside, the articulated half-poles will be able to fold without breaking at these hinges 14;

The presence of such hinges 14 makes it possible to fold the frame in an even more compact way by folding said sections 3 and 4 toward the outside EXT against one another for reducing the bulk.

The folded frame is thus very compact and can be easily housed in a bag or a housing of tubular shape, for example, of less than one meter of length.

The structure for a tent, according to the invention, folds and is deployed in several seconds, and its bulk is clearly less than that of the tents of the prior art, in particular the self-deploying tent described in the patent EP-B-1 697 604.

The invention claimed is:

1. A foldable tent structure, comprising:

a plurality of curved half-poles that are connected to one another in an upper part thereof according to a general radial arrangement so as to form, in a deployed state, a frame that supports fabric of the tent structure, the curved half-poles being able to be folded against one another to store the frame, each half-pole consisting of at least one lower section, and an upper section that is divided into two branches that extend, by separating from one another, toward distal ends thereof and are kept separated so as to constitute a lower arch and an upper arch arranged one below the other, the distal ends of the branches of the half-poles, which are pivotable, being mounted to pivot around at least one vertical axis of rotation located close to a central part of the structure, the branches of the half-poles being kept separated by at least one bracket arranged along said at least one axis of rotation, the lower sections of the half-poles each extending in a lower part thereof by a holding element of lower ends thereof relative to one another in the deployed state and forming a base of the structure designed to rest on the ground, the holding element being a rectilinear element of which a first end is connected to the lower section and a second end is mounted to pivot around at least one axis of rotation located in an extension of the at least one axis of rotation of the upper branches of the pivoting half-poles, the holding elements of the set of half-poles forming, in the deployed state, the base of the structure that is designed to rest on the ground, wherein the distal ends of the branches of the pivoting half-poles are mounted to pivot on a pair of connecting plates, disposed at a peak of the structure, around distinct vertical axes of rotation and separated from one another, at least two brackets being disposed between the pair of plates along the two axes of rotation so as to keep the branches of the half-poles separated, the rectilinear holding elements are connected to a lower connecting plate disposed at the base of the structure, perpendicular to the pair of connecting plates, the holding element being mounted to pivot around axes located in the extensions of the axes of rotation of the upper branches of the pivoting half-poles, and the holding elements of the set of half-poles and the lower connecting plate form, in the deployed state, the base of the frame that is designed to rest on the ground.

2. The structure according to claim 1, wherein the brackets are disposed between the pair of connecting plates along each of the axes of rotation.

3. The structure according to claim 1, wherein said axes of rotation are uniformly distributed on the periphery of the connecting plates to position said upper sections parallel to one another and said underframes parallel to one another, without overlapping, during the folding of the frame.

4. The structure according to claim 1, further comprising at least one additional half-pole, made integral with each of said connecting plates, wherein the pivoting half-poles are, in a clustered state of the half-poles, arranged on either side of said fixed half-pole.

5. A foldable tent structure, comprising:

a plurality of curved half-poles that are connected to one another in an upper part thereof according to a general radial arrangement so as to form, in a deployed state, a frame that supports fabric of the tent structure, the curved half-poles being able to be folded against one another to store the frame, each half-pole consisting of at least one lower section, and an upper section that is divided into two branches that extend, by separating from one another, toward distal ends thereof and are kept separated so as to constitute a lower arch and an upper arch arranged one below the other, the distal ends of the branches of the half-poles, which are pivotable, being mounted to pivot around at least one vertical axis of rotation located close to a central part of the structure, the branches of the half-poles being kept separated by at least one bracket arranged along said at least one axis of rotation, the lower sections of the half-poles each extending in a lower part thereof by a holding element of lower ends thereof relative to one another in the deployed state and forming a base of the structure designed to rest on the ground, the holding element being a rectilinear element of which a first end is connected to the lower section and a second end is mounted to pivot around at least one axis of rotation located in an extension of the at least one axis of rotation of the upper branches of the pivoting half-poles, the holding elements of the set of half-poles forming, in the deployed state, the base of the structure that is designed to rest on the ground, wherein the rectilinear holding elements are straps.

* * * * *